US006864768B2

(12) United States Patent
Passow et al.

(10) Patent No.: US 6,864,768 B2
(45) Date of Patent: Mar. 8, 2005

(54) SYSTEM AND METHOD FOR AUXILIARY CONTACT ASSEMBLY AND SNAP MOUNTING

(75) Inventors: Christian H. Passow, Ann Arbor, MI (US); James L. Coffman, Batavia, IL (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/961,159

(22) Filed: Sep. 21, 2001

(65) Prior Publication Data

US 2003/0057077 A1 Mar. 27, 2003

(51) Int. Cl.[7] ..... H01H 67/02
(52) U.S. Cl. ..... 335/132; 335/202
(58) Field of Search ..... 335/132, 202; 200/293–308

(56) References Cited

U.S. PATENT DOCUMENTS 3,290,628 A * 12/1966 McGary ..... 335/132
4,345,225 A * 8/1982 Lemmer ..... 335/132
4,774,484 A * 9/1988 Lehman et al. ..... 335/197
5,907,267 A * 5/1999 Reid et al. ..... 335/17

* cited by examiner

*Primary Examiner*—Lincoln Donovan

(57) ABSTRACT

An electrical switching system comprises a main housing enclosing an actuable apparatus including an actuator extending outwardly of the housing. A contact housing encloses an electrical contact and a pusher selectively actuable by the actuator to operate the contact. A mortise is provided on one of the main housing and contact housing and a tenon is provided on the other of the main housing and contact housing for joining the contact housing to the main housing. A snap lock resiliently locks the contact housing to the main housing.

20 Claims, 4 Drawing Sheets

SYSTEM AND METHOD FOR AUXILIARY CONTACT ASSEMBLY AND SNAP MOUNTING

CROSS-REFERENCE TO RELATED PATENT APPLICATIONS

The present U.S. patent application having at least one common inventor as U.S. patent application Ser. No. 09/961,155 entitled "System and Method for Auxiliary Contact Assembly", and U.S. patent application Ser. No. 09/961,162 entitled "System and Method for Mounting a Pusher and Moveable Contact in a Contact Block", and U.S. patent application Ser. No. 09/961,156 entitled "System and Method for Mounting a Moveable Contact in a Contact Block, and U.S. patent application Ser. No. 09/961,158 entitled "Contact Block Assembly and Method of Assembling a Contact Block Assembly", and U.S. patent application Ser. No. 09/961,161 entitled "Pusher Assembly and Method of Assembling a Pusher Assembly, and U.S. patent application Ser. No. 09/961,160 entitled "Moveable Contact and a Method of Assembling a Pusher Assembly having a Movable Contact, are filed with the U.S. Patent and Trademark Office concurrently on Sep. 21, 2001, the entirety of each being incorporated herein by reference.

TECHNICAL FIELD OF THE INVENTION

This invention relates to a contact assembly for use in an electrical switching apparatus designed to facilitate mounting thereon and removal therefrom.

BACKGROUND OF THE INVENTION

A conventional electrical switching apparatus in one known form typically comprises an electromagnetically actuable device having a magnetic core proximate an armature. Typically, a coil is electrically energized to draw the armature to the magnetic core. The electromagnetically actuated device may be a control relay, a contactor, a motor starter or the like. The armature is operatively associated with a movable device such as an actuator. With an electrical switching apparatus the actuator operates a contact assembly.

The contact assembly may be an integral component of the electrical switching apparatus or it may an auxiliary device to be added thereto. In the case of an auxiliary contact assembly, a housing conventionally supports an electrical contact and a pusher. The pusher is selectively actuated to operate the contact. One such conventional auxiliary contact assembly is removably mounted to a side of the electromagnetically actuable device. A mortise and tenon construction joins the auxiliary contact device to the electromagnetically actuable device. A side mounted screw and nut are turned to lock the auxiliary contact assembly on the electromagnetically actuable device. This requires the use of a screwdriver and some care in controlling orientation of the screw and nut during installation and removal. Moreover, the user must have side access to the electromagnetically actuable device which might require removal of the device from a panel.

Accordingly, there is a need for a contact assembly for use in electrical switching apparatus designed to facilitate mounting thereon and removal therefrom.

SUMMARY OF THE INVENTION

In accordance with the invention there is provided a contact assembly for use in electrical switching apparatus designed to facilitate mounting thereon and removal therefrom.

Broadly, there is disclosed herein a contact assembly for use in an electrical switching apparatus having an actuator. The contact assembly includes a housing enclosing an electrical contact and a pusher selectively actuable by the actuator to operate the contact. Means are provided for joining the housing to the electrical switching apparatus and means for resiliently locking the housing to the electrical switching apparatus.

It is a feature of the invention that the joining means comprises a tenon on the housing received in a mortise on the electrical switching apparatus. It is another feature of the invention that the joining means comprises a dove-tail joint joining the housing to the electrical switching apparatus.

It is another feature of the invention that the locking means comprises a snap lock.

It is still a further feature of the invention that the locking means comprises a flexible web extending from the housing with a projection on the web engaging a rib on the electrical switching apparatus.

There is disclosed in accordance with another aspect of the invention an electrical switching system comprising a main housing enclosing an actuable apparatus including an actuator extending outwardly of the housing. A contact housing encloses an electrical contact and a pusher selectively actuable by the actuator to operate the contact. A mortise is provided on one of the main housing and contact housing and a tenon is provided on the other of the main housing and contact housing for joining the contact housing to the main housing. A snap lock resiliently locks the contact housing to the main housing.

It is a feature of the invention that the main housing comprises first and second parallel ribs having facing channels to define the mortise and a third rib extending angularly from the first and second ribs. The snap lock comprises a flexible web extending from the contact housing with a projection on the web engaging the third rib. The tenons extend from the web in alignment with the projection. A blade extends from the web to guide the snap lock.

There is disclosed in accordance with still another aspect of the invention an electrical switching system comprising a main housing enclosing an actuable apparatus including an actuator having opposite ends extending outwardly of opposite sides of the main housing. A contact housing encloses an electrical contact and a pusher selectively actuable by the actuator to operate the contact. A mortise on each side of the main housing and a tenon on each side of the contact housing join the contact housing to either side of the main housing with the pusher proximate one of the ends of the actuator. A snap lock resiliently locks the contact housing to the main housing.

There is disclosed in accordance with yet another aspect of the invention the method of mounting a contact block to an electrical switching apparatus, comprising providing a main housing enclosing an actuable apparatus including an actuator having opposite ends extending outwardly of opposite sides of the main housing and a mortise on each side of the main housing aligned with a rib; providing a contact housing enclosing an electrical contact and a pusher selectively actuable by the actuator to operate the contact and having a tenon and a snap lock element; joining the contact housing to either side of the main housing with the pusher proximate one of the ends of the actuator by sliding the tenon in one of the mortises; and resiliently locking the contact housing to the main housing by engaging the ribs with the snap lock element.

DETAILED DESCRIPTION OF THE INVENTION

Figure 1:
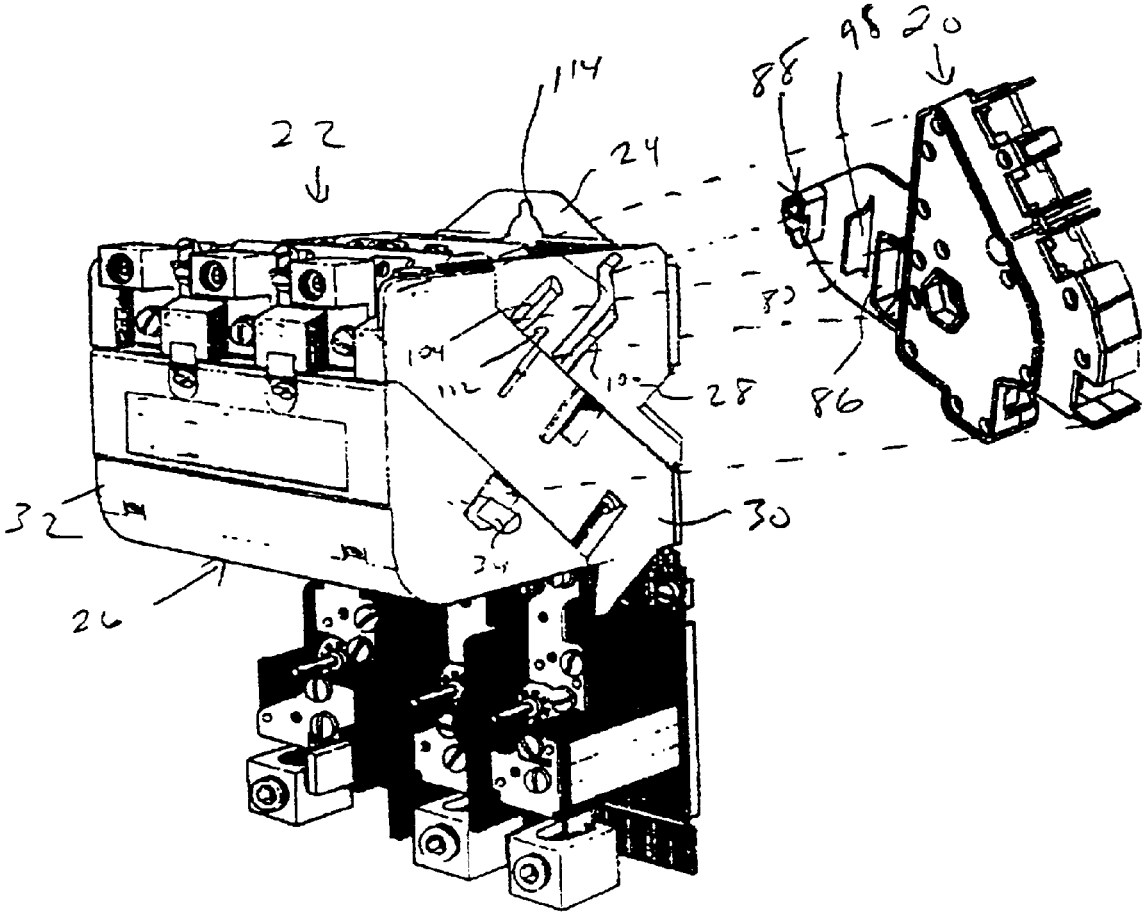
FIG. 1 is a perspective view illustrating a contact assembly used with an electrical switching apparatus in accordance with the invention.

Referring to FIG. 1, a contact assembly in the form of an auxiliary contact block 20 for use with an electrical switching apparatus in the form of an electrical contactor 22 is illustrated. The present invention relates to use of a snap mounting for removably mounting the auxiliary contact block 20 to the contactor 22, as described below.

The contactor 22 is an electromagnetically actuable device and includes a mounting plate 24 for mounting in a control panel or the like. A main housing 26 is mounted to the mounting plate 24. The main housing 26 includes a base 28, a switch housing 30 and a cover 32. Although not specifically illustrated herein, the main housing 26 encloses an electrical coil associated with a magnetic core and armature for driving an actuator having opposite ends 34, one of which is shown in FIG. 1. Additionally, the main housing 26 encloses various electrical contacts which can be opened or closed responsive to energization of the coil. The actuator ends 34 extend outwardly of opposite sides of the main housing 26. As a result, the auxiliary contact block 20 can be mounted to either side of the main housing 26.

Figure 2:
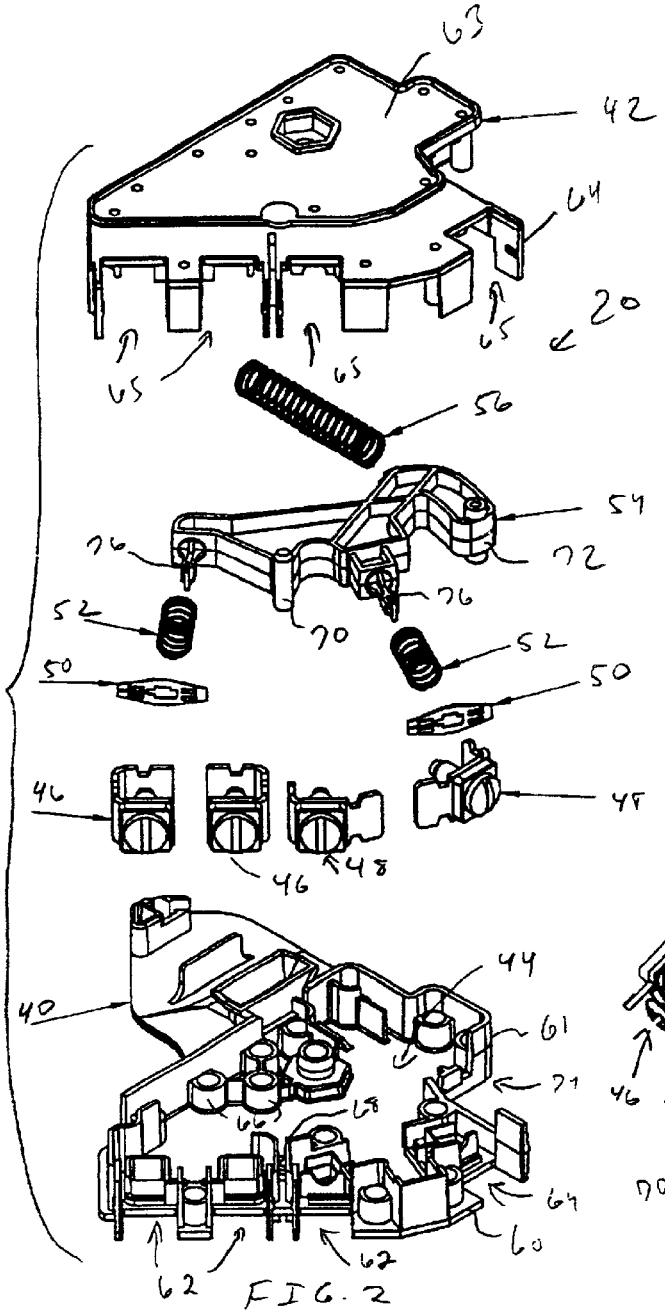
FIG. 2 is an exploded view of the contact assembly of FIG. 1.
Figure 3:
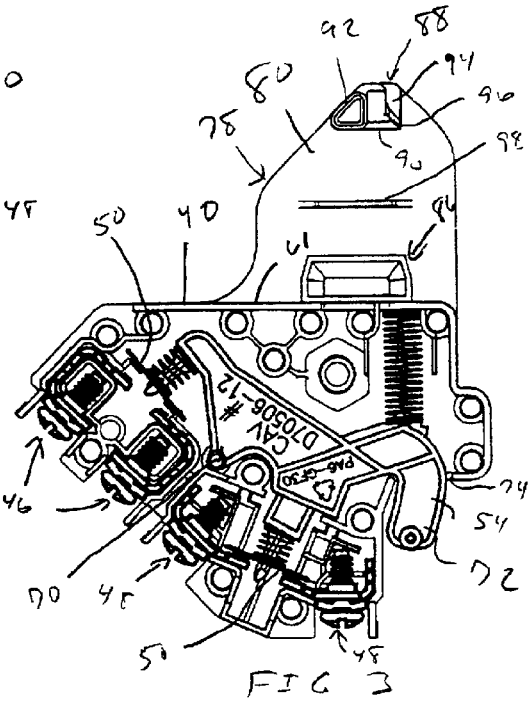
FIG. 3 is a plan view of the contact assembly of FIG. 2 with a cover removed.

Referring to FIGS. 2 and 3, the auxiliary contact block 20 includes a housing 40 and a cover 42 to define an interior space 44. Both the housing 40 and cover 42 are of one-piece molded plastic. Mounted in the interior space 44 are a pair of stationary normally open contacts 46, a pair of stationary normally closed contacts 48, a pair of movable contacts 50, a pair of contact springs 52, a pusher 54 and a return spring 56.

The housing 40 includes a generally planar outer wall 60 connected to an upwardly turned side wall 61. The side wall 61 extends generally around the perimeter of the outer wall 60 except for terminal openings 62. The cover 42 includes a generally planar outer wall 63 connected to a downwardly turned partial side wall 64. The side wall 64 extends generally around a portion of the perimeter of the outer wall 63 and provides terminal openings 65. Particularly, the cover outer wall 63 is virtually a mirror image of the housing outer wall 60. The cover side wall 64 and housing side wall 61 provide a perimeter wall around the interior space 44 with the openings 62 and 64 in the same positions to provide external access to the stationary contacts 46 and 48. A plurality of collars 66 extend upwardly from the housing outer wall 60. The collars 66 receive posts (not shown) extending downwardly from the cover outer wall 63 to retain the cover 42 on the housing 40.

An annular ring 68 on the housing outer wall 60, and a similar annular ring (not shown) on the cover outer wall 63, receive a pivot post 70 of the pusher 54 to pivotally mount the pusher 54 in the interior space 44. The pusher 54 also includes an arm 72 that extends outwardly of an opening 74 in the housing side wall 61, as particularly illustrated in FIG. 3. The pusher 54 also includes a post 76 extending outwardly on either side of the pivot post 70. Each post 76 is adapted to receive one of the contact springs 52 and movable contacts 50.

The stationary contacts 46 and 48 are mounted in the housing 40 as illustrated in FIG. 3. With the pusher 54 pivotally mounted in the housing 40, each of the movably contacts 50 is positioned in proximity to one of the stationary contact pairs 46 or 48. In the illustrated embodiment of the invention, one of the movable contacts 50 provides a normally open contact arrangement relative to the stationary contacts 46 and a normally closed contact relationship relative to the stationary contacts 48. Other contact relationships may also be used. The return spring 56 biases the pusher 54 into a normal position. The stationary contacts 46 and 48 and pusher 54 and return spring 56 are loosely held in the interior space 44 captured between the cover 42 and the housing 40.

In operation, depressing the pusher arm 72 against the return spring causes the state of the movable contacts 50 relative to the contact pairs 46 or 48 to change from open to close and close to open, respectively. Releasing the arm 72 causes the pusher 54 to return to the normal position under the force of the return spring 56. The contact springs 52 maintain a bias on the movable contacts 50 so they maintain desired contact with the stationary contacts 46 or 48.

The housing 40, cover 42, movable contacts 50, stationary contacts 46 and 48 and contact springs 52 can be used to create a variety of switching arrangements with different make and break configurations and timing by varying the geometry of the pusher 54 and the point about which the pusher 54 pivots.

Figure 4:
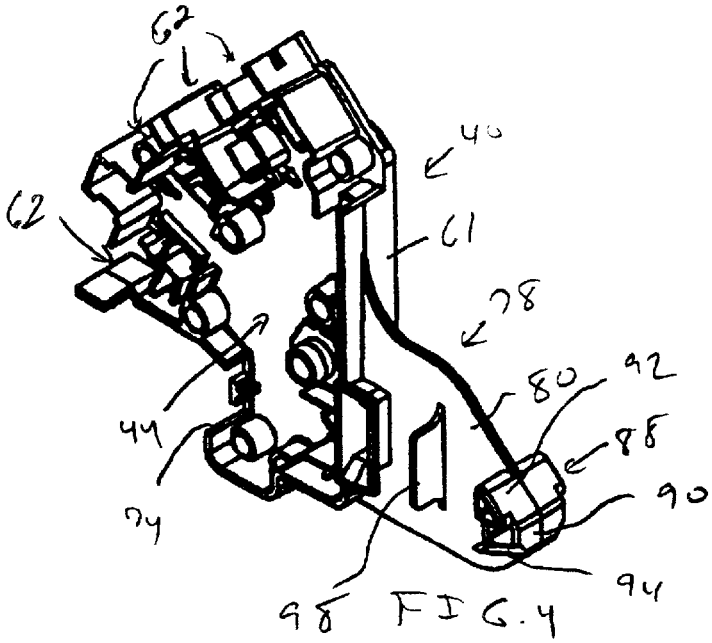
FIG. 4 is a perspective view of a housing of the contact assembly of FIG. 2.
Figure 5:
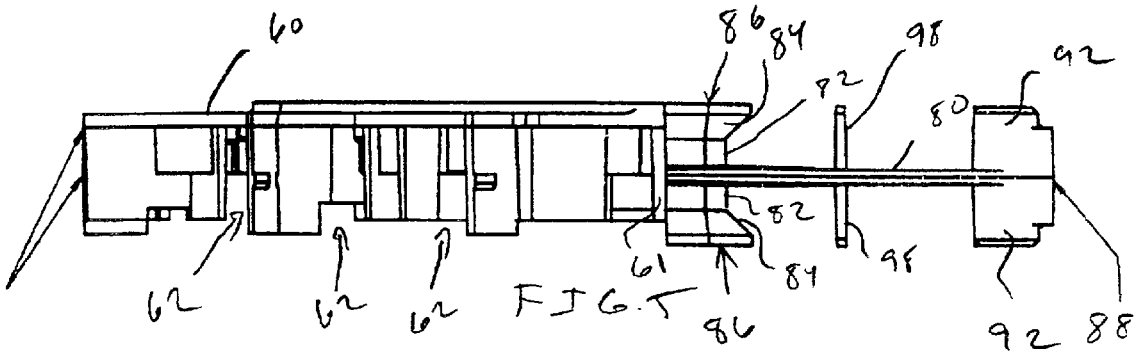
FIG. 5 is a side elevation view of the housing of FIG. 4.

Referring to FIGS. 4 and 5, a snap lock 78 is integrally formed with the housing 40 and extends outwardly from the side wall 61, opposite the openings 62. The snap lock 78 comprises a planar web 80 extending perpendicularly from the side wall 61 just above its center line relative to the outer wall 60. As such, when the cover 42 is mounted on the housing 40, the web 80 is generally centrally located.

A generally rectangular element 82 is connected on either side of the web 80 into the side wall 61. A diagonal wall 84 extends around each rectangular wall 82 to define a tenon 86 on each side of the web 80. A projection 88 is connected to a distal end of the web 80 on each side thereof. Each projection 88 comprises a generally square shaped wall 90 and a generally triangular wall 92. The square shaped wall 90 and the generally triangular wall 92 extend upwardly from either side of the web 80 and include a common wall. The square shaped wall 90, opposite the triangular wall 92, includes an upwardly extending ramp wall 94 to define a shoulder 96. A blade 98 extends from each side of the web 80 between the tenon 86 and the projecting end 88.

Figure 6:
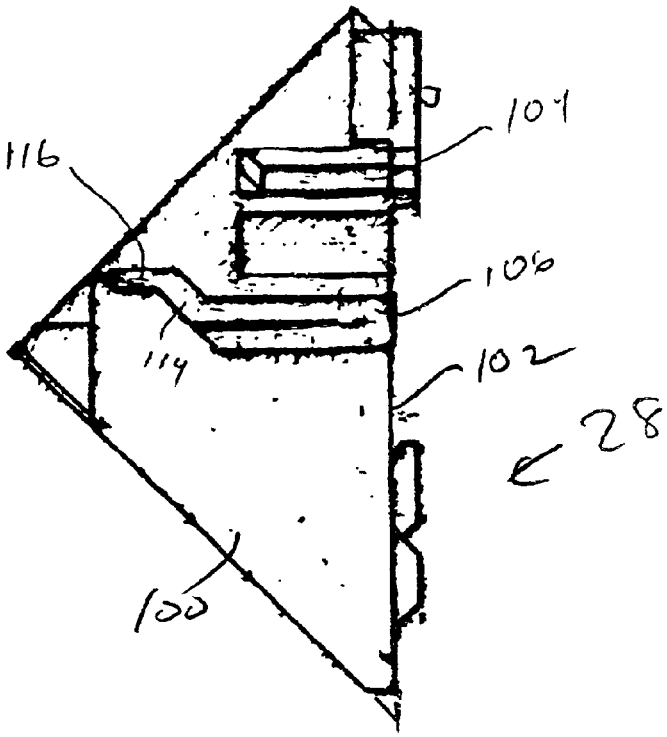
FIG. 6 is a side elevation view of a base of the electrical switching apparatus of FIG. 1.
Figure 7:
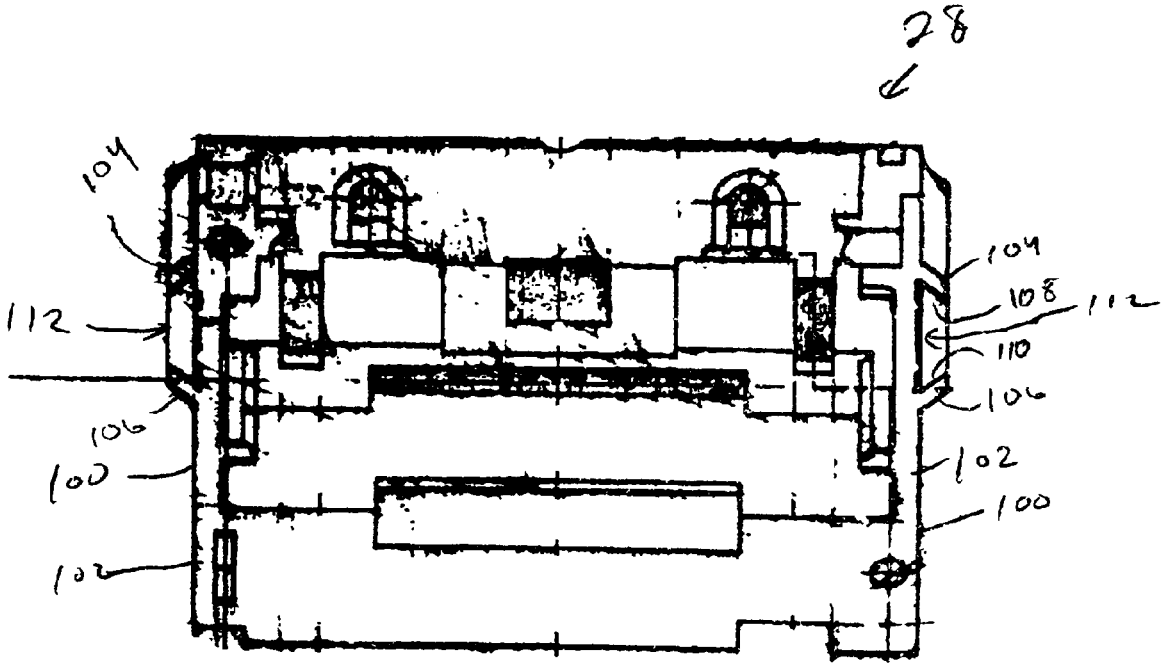
FIG. 7 is an inside plan view of the base of FIG. 6.

Referring to FIGS. 6–8, the main housing base 28 is illustrated. The base 28 is formed of an insulating material which may be plastic.

The base 28 includes opposite side walls 100 each having a front edge 102. First and second parallel ribs 104 and 106 on each side wall 100 extend from each front edge 102. The ribs 104 and 106 are in the form of opposite parallelograms to provide facing channels 108 and 110, see FIG. 7, to define a dovetail mortise 112. A third rib 114 extends diagonally from the second rib 106 opposite the front edge 102. The second rib 114 ends in a turned end 116.

To mount the contact block 20 to the main housing 26, the contact block 20 is positioned on the main housing with the pusher arm 72, see FIG. 3, depressed so that the opening 74 can be located proximate one of the actuator ends 34. The contact block 20 is then turned so that the projecting end 88 and the blade 98 are located between the ribs 104 and 106. The contact block 20 is the moved linearly in line with the ribs 104 and 106 and the blade 98 guides the contact block 20 so that the dovetail tenon 86 is received in the dovetail mortise 112 to join the contact block 20 to the main housing 26. As the contact block 20 is continually moved, the projecting end ramped wall 94 engages the third rib 114 and causes the web 80 to flex outwardly until the projecting end 88 just clears the third rib 114 and snaps in place with the shoulder 98 captured outside the third rib 114 adjacent its turned distal end 116 to provide a snap lock arrangement. As such, the contact block 20 can be snap mounted from in front of the contactor 22. The contact block 20 can be easily removed by flexing the web 80 outwardly so that the projecting end 88 clears the third rib 114 and then sliding the contact block 20 forwardly and downwardly until the dovetail tenon 86 clears the dovetail mortise 112.

Although the mortise and tenon joints described herein are in the form of a dovetail, other configurations of a mortise could be used, as will be recognized by those skilled in the art. Moreover, other joining structures may be used to join the contact block 20 to the main housing 26 in connection with the snap lock 78.

By providing the tenon 86, blade 98 and projecting end 88 on both sides of the web 80, and by providing the mortise 112 on both sides of the base 28, the contact block 20 can be mounted on either side of the contactor 22.

It can therefore be appreciated that a new and novel system and method for snap mounting a contact block to an actuator apparatus has been described. It will be appreciated by those skilled in the art that, given the teaching herein, numerous alternatives and equivalents will be seen to exist which incorporate the disclosed invention. As a result, the invention is not to be limited by the foregoing exemplary embodiments, but only by the following claims.

We claim:

1. A contact assembly for use in an electrical switching apparatus having an actuator, comprising:

a housing enclosing an electrical contact and a pusher selectively actuable by the actuator to operate the contact;

means for operatively joining the housing to the electrical switching apparatus using linear motion of the housing from in front of the electrical switching apparatus comprising a tenon on the housing received in a mortise on the electrical switching apparatus; and means actuated by the linear motion of the housing in a single axis motion from in front of the electrical switching apparatus for engaging and resiliently locking the housing to the electrical switching apparatus.

2. The contact assembly of claim 1 wherein the joining means comprises a dovetail joint joining the housing to the electrical switching apparatus.

3. The contact assembly of claim 1 wherein the locking means comprises a snap lock.

4. The contact assembly of claim 1 wherein the locking means comprises a flexible web extending from the housing with a projection on the web engaging a rib on the electrical switching apparatus.

5. An electrical switching system comprising:

a main housing enclosing an actuable apparatus including an actuator extending outwardly of the main housing;

a contact housing enclosing an electrical contact and a pusher selectively actuable by the actuator to operate the contact;

a mortise on one of the main housing and contact housing and a tenon on the other of the main housing and contact housing for joining the contact housing to the main housing using linear motion of the contact housing from in front of the main housing; and a snap lock actuated by the linear motion of the contact housing in a single axis motion from in front of the main housing for engaging and resiliently locking the contact housing to the main housing.

6. The electrical switching system of claim 5 wherein the mortise and tenon comprise a dovetail joint joining the contact housing to the main housing.

7. The electrical switching system of claim 5 wherein the snap lock comprises a flexible web associated with the contact housing with a projection on the web engaging a shoulder on the main housing.

8. The electrical switching system of claim 5 wherein the main housing comprises first and second parallel ribs having facing channels to define the mortise and a third rib extending angularly from the first and the second ribs.

9. The electrical switching system of claim 8 wherein the snap lock comprises a flexible web extending from the contact housing with a projection on the web engaging the third rib.

10. The electrical switching system of claim 9 wherein the tenon extends from the web in alignment with the projection.

11. The electrical switching system of claim 10 further comprising a blade extending from the web to guide the snap lock.

12. An electrical switching system comprising:

a main housing enclosing an actuable apparatus including an actuator having opposite ends extending outwardly of opposite sides of the main housing;

a contact housing enclosing an electrical contact and a pusher selectively actuable by the actuator to operate the contact;

a mortise on each side of the main housing and a tenon on each side of the contact housing for joining the contact housing to either side of the main housing with the pusher proximate one of the ends of the actuator using linear motion of the contact housing from in front of the main housing; and a snap lock actuated by the linear motion of the contact housing in a single axis motion from in front of the main housing for engaging and resiliently locking the contact housing to the main housing.

13. The electrical switching system of claim 12 wherein the mortise and tenon comprise a dovetail joint joining the contact housing to the main housing.

14. The electrical switching system of claim 12 wherein the snap lock comprises a flexible web associated with the contact housing with a projection on the web engaging a shoulder on the main housing.

15. The electrical switching system of claim 12 wherein each side of the main housing comprises first and second parallel ribs having facing channels to define the mortise and a third rib extending angularly from the first and the second ribs.

16. The electrical switching system of claim 15 wherein the snap lock comprises a flexible web extending from the contact housing with a projection on an end of the web engaging one of the third ribs.

17. The electrical switching system of claim 12 wherein each tenon extends from opposite sides of the web in alignment with the projection.

18. The electrical switching system of claim 17 further comprising a blade extending from opposite sides of the web to guide the snap lock.

19. The method of mounting a contact block to an electrical switching apparatus, comprising:

providing a main housing enclosing an actuable apparatus including an actuator having opposite ends extending outwardly of opposite sides of the main housing and a mortise on each side of the main housing aligned with a rib;

providing a contact housing enclosing an electrical contact and a pusher selectively actuable by the actuator to operate the contact and having a tenon and a snap lock element;

joining the contact housing to either side of the main housing with the pusher proximate one of the ends of the actuator by sliding the tenon in one of the mortises using linear motion of the contact housing from in front of the main housing; and resiliently locking the contact housing to the main housing by engaging the rib with the snap lock element responsive to the linear motion of the contact housing in a single axis motion from in front of the main housing.

20. The method of claim 19 wherein providing a contact housing comprises providing a flexible web associated with the contact housing with a projection on the web to define the snap lock element.

* * * * *